United States Patent [19]

Galloway et al.

[11] Patent Number: 4,550,312

[45] Date of Patent: Oct. 29, 1985

[54] REMOTE SENSING SYSTEMS

[75] Inventors: John L. Galloway, Edinburgh; Timothy R. F. Hankins, Balerno, both of Scotland

[73] Assignee: Racal Security Limited, Newbridge, Scotland

[21] Appl. No.: 557,104

[22] Filed: Dec. 1, 1983

[30] Foreign Application Priority Data

Dec. 2, 1982 [GB] United Kingdom ..... 8234442

[51] Int. Cl.[4] ..... G08B 1/08

[52] U.S. Cl. ..... 340/539; 340/531; 340/534; 340/346; 455/161

[58] Field of Search ..... 340/539, 531, 506, 533, 340/534, 536, 345, 346, 349, 350; 455/9, 39, 49, 53, 58, 161, 164, 165, 166

[56] References Cited

U.S. PATENT DOCUMENTS

| | | | |
|---|---|---|---|
| 3,714,585 | 1/1973 | Koch | 455/166 |
| 3,909,722 | 9/1975 | Bennett, Jr. | 340/539 |
| 4,450,586 | 5/1984 | Fujino | 455/161 |

FOREIGN PATENT DOCUMENTS

| | | |
|---|---|---|
| 1019336 | 2/1966 | United Kingdom . |
| 1487073 | 9/1977 | United Kingdom . |
| 1489195 | 10/1977 | United Kingdom . |
| 1539792 | 2/1979 | United Kingdom . |

*Primary Examiner*—Donnie L. Crosland

*Attorney, Agent, or Firm*—Leydig, Voit & Mayer, Ltd.

[57] ABSTRACT

A security installation comprises a plurality of sensors in and around a building and which transmit digital information to a central station by radio, in each case preceded by an access code specific to the particular installation; signals inadvertently received from the sensors of an adjacent installation are rejected. The information is transmitted by encoding a multiple bit word incorporating the access code, a code indentifying the particular sensor, and the actual data. The sensor transmitters may drift over a wide bandwidth. To avoid using a wide band receiver in the master station, the receiver bandwidth is narrow but swept over the wide bandwidth. As soon as a signal is detected, the sweep is halted until the recognition process has been completed. In an alternative version, if the transmitter frequencies are stable, each sensor is allocated a different transmitting frequency and the receiver in the master station is caused to hop from one frequency to another, thus providing a further step in the recognition process.

3 Claims, 5 Drawing Figures

REMOTE SENSING SYSTEMS

BACKGROUND OF THE INVENTION

The invention relates to remote sensing systems, that is, systems having one or more sensors for sensing particular parameters or changes in such parameters and which are remote from a station which is intended to respond to information received from the sensor or sensors. One particular example of such a system is a security system in which there are a plurality of sensors situated at different positions in an area to be monitored (such as a building or house or part of a building such as a flat or apartment) and arranged to sense (for example) the presence of an intruder, the movement of an object, fire or smoke or inadvertent escape of a substance such as gas or water, each sensor being arranged to transmit signals representative of what it is sensing to a master station which is in or near the area being monitored and which then responds by taking appropriate action such as emitting a warning signal or causing such a signal to be transmitted to a distant location (as by means of a telephone line).

SUMMARY OF THE INVENTION

According to the invention, there is provided an information transmitting system, comprising a group of remote units for transmitting information to a respective master station by radio, each remote unit having a basic transmission frequency which is subject to drift over not more than a predetermined relatively broad bandwidth, the master station comprising receiving means having a narrow operating bandwidth and sweeping means for sweeping the centre frequency of the narrow operating bandwidth over the predetermined broad bandwidth.

According to the invention, there is also provided an information transmitting system, comprising a plurality of remote units for transmitting information to a master station by radio, in which each remote unit includes radio transmission circuitry having a predetermined stable operating frequency, the predetermined operating frequencies of all the remote units being spread over a predetermined bandwidth, and in which the master station includes receiving circuitry whose operating frequency is adjustable, and including frequency control means operative to sweep the operating frequency of the receiving circuitry to each of the transmitter operating frequencies in turn.

DESCRIPTION OF THE DRAWINGS

A security installation embodying the invention will now be decribed by way of example only and with reference to the accompanying drawings in which.

DESCRIPTION OF PREFERRED EMBODIMENTS

Figure 1:
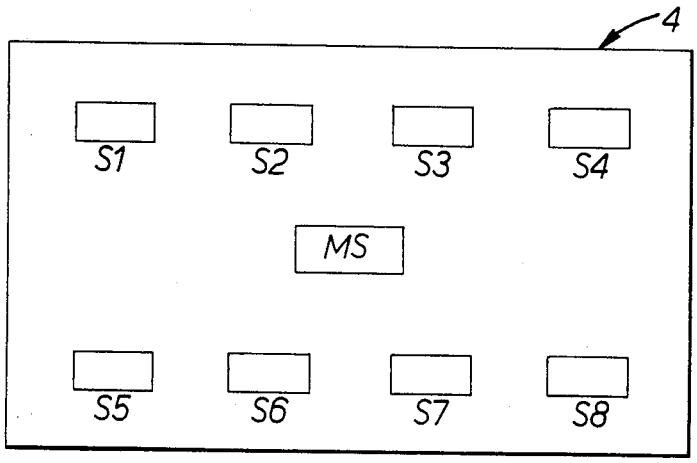
FIG. 1 is a block diagram of one of the installations.

As shown in FIG. 1, the security installation has eight (in this example) sensors S1, S2 . . . S8 which are distributed around an area to be monitored, which might be a building 4. Located in or near the building is a master station MS. Each sensor S1 to S8 is arranged to detect a particular occurrence, as explained above: for example, the presence of an intruder, the movement of an object (e.g. removal of a painting), fire or smoke, or undesired escape of a potentially damaging or dangerous substance such as water or gas. In response to such detection, each sensor signals accordingly to the master station MS which then takes appropriate preventative or warning action. Communication between the sensors and the master station is by means of radio, thus considerably easing the problems involved in installing the system in an existing building such as occur with systems in which the sensors are connected to the master station by wired links. Advantageously, the sensors S1 to S8 have very low power consumption and incorporate their own power supplies.

Figure 2:
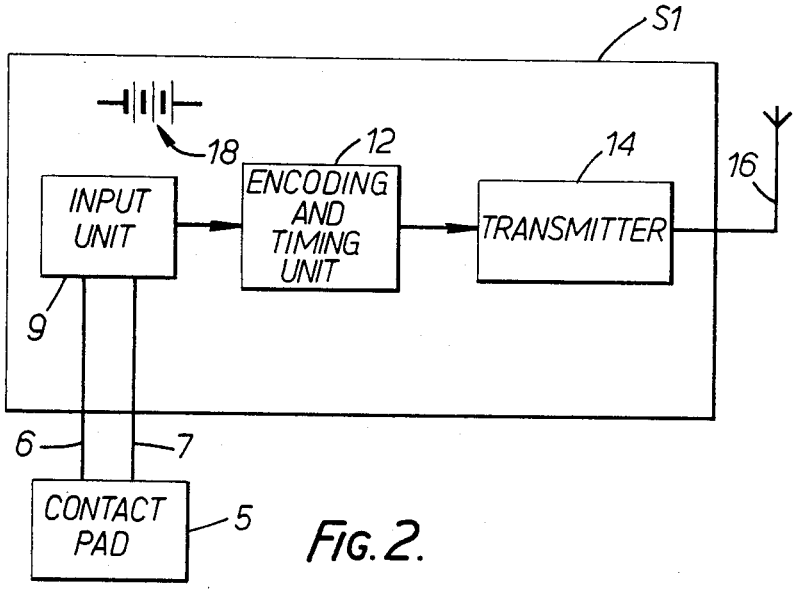
FIG. 2 is a block diagram of a sensor in the installation of FIG. 1.

FIG. 2 shows diagrammatically one of the sensors S1 in more detail. As shown, it comprises a contact pad or mat 5 (in this example) such as for placing under a floor covering adjacent a door or window in the building under surveillance so that contacts are closed when an intruder steps on the floor covering, and a corresponding electrical signal is produced on lines 6 and 7 which are connected to an input unit 9. The latter produces a corresponding electrical output signal which is fed to an encoding and timing unit 12. This encodes the signals into suitable form to modulate a radio transmitter 14 which transmits the signals via an antenna 16 to the master station MS.

The units of the sensor are powered by a battery power supply indicated at 18, the connections between this and the units of the sensor being omitted for clarity.

The signals produced by the input unit 9 are preferably produced in digital form and transmitted over the radio link in any suitable way such as by frequency shift keying.

It will be appreciated that installations such as shown in FIG. 1 may inevitably be positioned adjacent to each other, such as in adjacent apartments in an apartment block. Although the sensors are arranged to radiate at low power (this will normally be required by Government regulations in any case), it will not be possible to ensure that the signals radiated by the sensors of one installation will not reach the master station of an adjacent installation. Therefore, in order to prevent the master station from reacting to signals radiated by the sensors of another installation, the radio signals transmitted by the sensors of each installation are prefixed by an "access code" which is particular to that installation and is recognised only by the master station of that installation.

Figure 3:
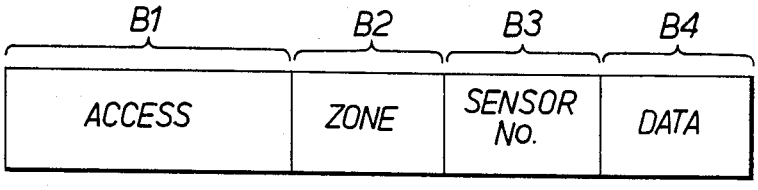
FIG. 3 illustrates the format of data signals transmitted in the installation of FIG. 1.

FIG. 3 shows one form which the information produced by a sensor can take. In this example, the information comprises 20 bits arranged in blocks.

Block B1 contains eight bits and represents the access code which is particular to that installation. Block B2 consists of four bits and identifies the zone (e.g. a particular room) in which the sensor is located. Block B3, also of four bits, identifies the serial number of the sensor within the particular zone. Finally, block B4, again of four bits, is the actual data, that is, representing the state of the sensor (the state of the contact pad 5 in this particular example).

The sensors may be arranged to operate in a variety of ways. For example, they may be normally quiescent but arranged to respond to a change in the situation being monitored (closure of the contacts in the contact pad in the case of the sensor of FIG. 2) by transmitting a message carrying the data indicating the changed situation. At the end of the message, the monitored situation is reviewed and, if it has changed, a new message is transmitted, carrying revised data.

If desired, the sensors can also be arranged so as automatically to transmit a message at regular or irregular intervals, whether or not there has been a change in the situation being monitored.

Figure 4:
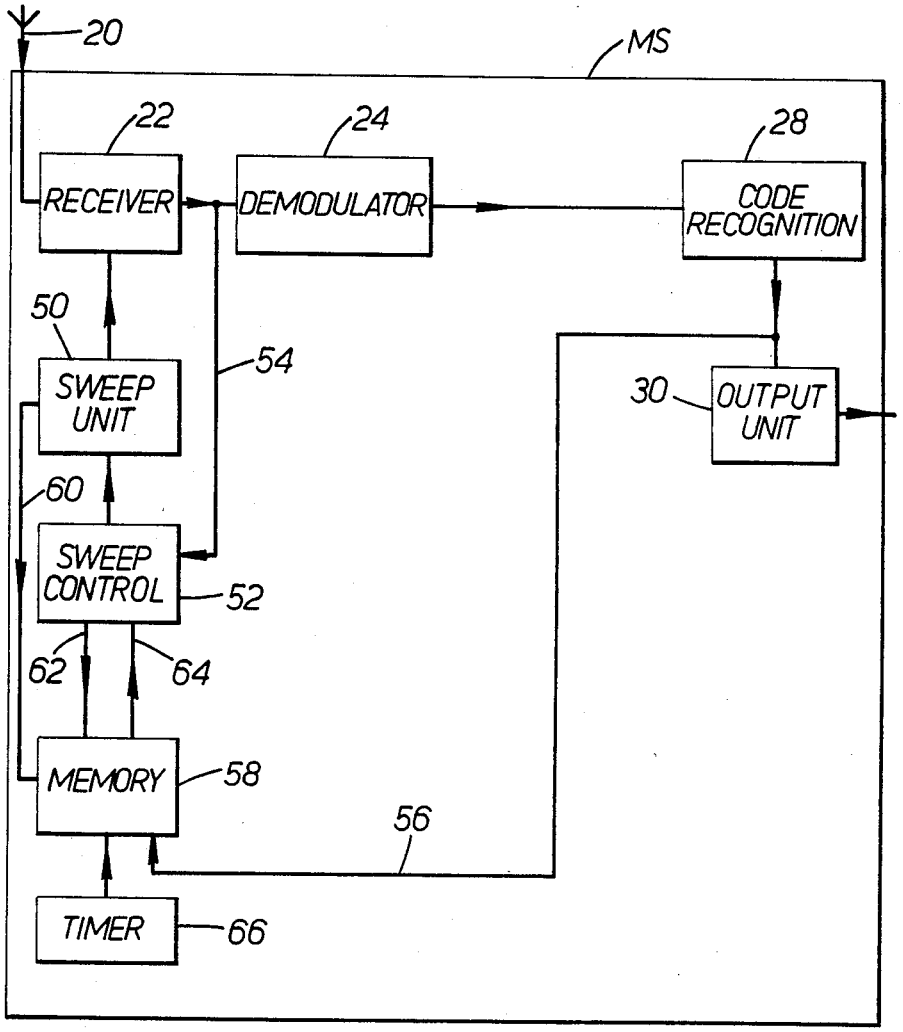
FIG. 4 is a block circuit diagram of a master station used in the installation.

FIG. 4 shows the master station in block diagram form.

The master station has a receiving antenna 20 which feeds the received signals to a receiver 22. The received signals are demodulated in a demodulator 24 and the demodulated signals are fed to a code recognition unit 28. This checks the access code (block B1, FIG. 3) to establish whether the received transmission has originated from a sensor within the particular installation. If the code recognition unit 28 indicates recognition, a data output unit 30 extracts the information in Blocks B2, B3 and B4 and responds accordingly, as by giving an alarm and/or transmitting an alarm signal to a distant location.

In one form of the installation as so far described, the radio transmitters 14 within each sensor may be of a type which tend not to be particularly stable in frequency and, in particular, may drift in carrier frequency over quite a wide range due to the effects of ambient temperature changes and ageing and other effects for example. The total bandwidth over which the transmitters of the sensors may drift may extend from 505 to 520 MHz for example, as shown at BW1 in FIG. 5A.

Figure 5:
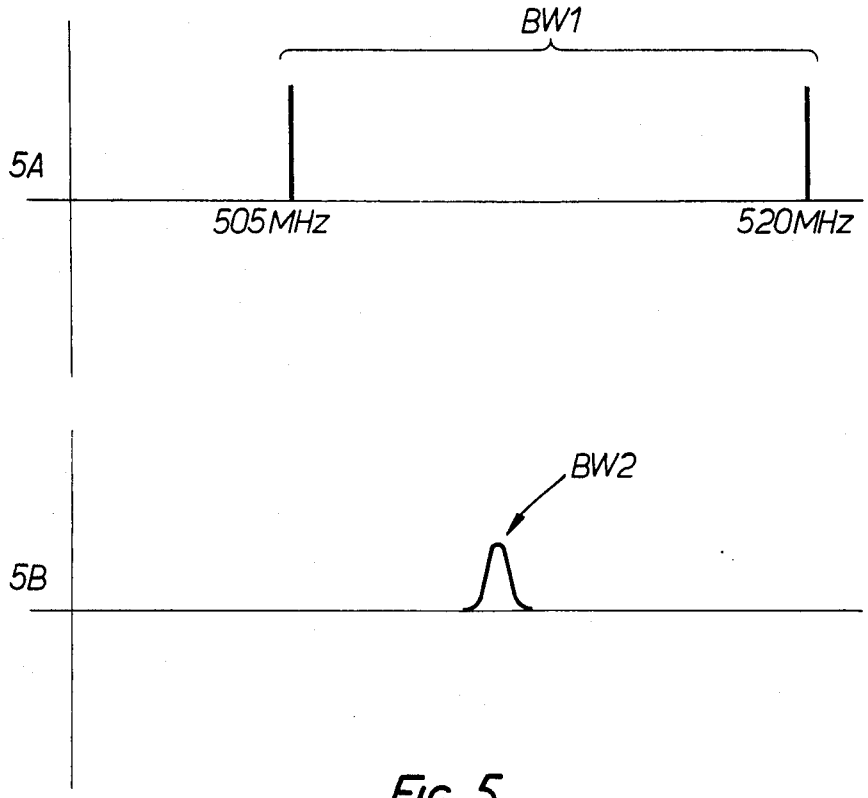
FIG. 5 shows a bandwidths of transmitters and receivers used in the installation of FIG. 1.

In accordance with a feature of the system being described, the receiver in the master station MS, instead of being a wide band receiver having a bandwidth BW1 corresponding to that shown in FIG. 5A, is of narrow bandwidth but its operating frequency is swept over the band shown in FIG. 5A. Thus, as shown in FIG. 5B, BW2 indicates the bandwidth of the receiver 22. This bandwidth may be between 100 and 500 KHz for example. As shown in FIG. 4, a sweep unit 50 is provided which sweeps the operating frequency of the receiver (that is, the centre frequency of the bandwidth BW2) over the full (in this example) bandwidth BW1. Therefore, even though the transmitters 14 in the sensors may have a tendency to drift, the need for a very wide bandwidth receiver, with the increased risk of picking up spurious transmissions, is avoided.

The sweep unit 50 in FIG. 4 is controlled by a sweep control unit 52. This has a basic mode of operation in which it causes the receiver frequency to sweep rapidly over the 505 to 520 MHz bandwidth, completing a full sweep in, say, 100 milliseconds at maximum scan speed. However, as soon as a transmission is detected at a particular frequency, a signal from the output of the receiver on a line 54 is fed to the sweep control unit 52 and stops the sweep temporarily. The receiver is thus held to the frequency on which the signals are being received at that time and the demodulating and recognition processes already described are carried out. When recognition has taken place, a signal on a line 56 causes the sweep control unit 52 to start sweeping again (from the frequency at which it was temporarily stopped). The master station MS may also include a memory 58 for storing the values of the frequencies at which transmission are detected. The memory continuously receives signals representative of the receiver frequency at any time by means of a line 60. Each time the sweep control unit 52 is halted (in response to a signal on line 54), a signal is passed to the memory 58 on a line 62 and causes the memory to store the receiver frequency at that time. During subsequent sweeps, the stored frequencies are output to the sweep control unit 52 on a line 64. Instead of merely causing the sweep unit 50 to sweep the receiver frequency smoothly over the total bandwidth, the sweep control unit 52 causes the scanning unit 50 to step the receiver frequency substantially instantaneously to the region of each of the stored frequencies in turn. The receiver frequency is not stepped exactly to each of the stored frequencies, because this would not enable account to be taken of drift which may have occurred. However, the sweep control unit 52 assumes that the transmitter corresponding to each stored frequency will not have drifted by more than a predetermined amount (500 KHz, say) from the stored value and therefore causes the scanning unit 50 to set the receiver to, 500 KHz below the stored frequency. It is then scanned to 500 KHz above this frequency, and the transmitted frequency should be located within this bandwidth.

A timer 66 may be provided for clearing each stored frequency from the memory 58 when such time has elapsed that it is no longer safe to assume that each transmitter will be within 500 KHz of the stored value.

In an alternative mode of operation, which is applicable when the transmitters 14 in the sensors are of high stability, the sensors within a particular installation may be arranged to operate at different predetermined frequencies. The sweep unit 50 and the sweep control unit 52 now no longer operate to sweep the receiver frequency smoothly over the wide bandwidth but instead cause the receiver frequency to hop to each of the predetermined frequencies of the sensor transmitters in turn. This channelising of the sensor output signals therefore provides an additional safeguard against the incorrect signals being received.

What is claimed is:

1. An alarm-condition monitoring system, comprising a master station, a group of alarm-condition-sensing remote units for respectively sensing the existence of alarm-conditions and transmitting information signals relating thereto to the master station by radio, each remote unit having a basic radio transmission frequency which is nominally the same as that of each other of the remote units but is subject to drift over not more than a predetermined relatively broad bandwidth, the master station comprising (a) receiving means having a narrow operating radio bandwidth, (b) sweeping means for sweeping the centre frequency of the narrow operating bandwidth over the predetermined broad bandwidth, (c) sweep-interrupting means responsive to detection of a received signal for temporarily stopping the sweep, (d) storage means operative in response to sweeping of the operating frequency of the receiving means over the said broad bandwidth to store those values of the receiver operating frequency at which signals are received by the receiving circuitry, and (e) means responsive to the stored frequency values to control the operation of the sweeping means during at least one subsequent sweep whereby the sweeping means carries out accelerated sweeps to within respective predetermined ranges each encompassing a respective one of the stored frequencies and is operative to carry out a normal sweep through each such range.

2. A system according to claim 1 where the information signals transmitted by each remote unit are encoded in a manner intended to be recognized by the master station, in which the master station includes recognition means for testing the signals for recognition, and in which the sweep-interrupting means interrupts the said sweep at least until the recognition means has tested the received signal for recognition.

3. A system according to claim 1, in which the remote units are sensors each for sensing a particular situation or a change in a particular situation, and the information transmitted by each remote unit identifies that unit and indicates the said situation or any change therein.

* * * * *